US009204776B1

(12) United States Patent
Dinh

(10) Patent No.: US 9,204,776 B1
(45) **Date of Patent: *Dec. 8, 2015**

(54) MULTI-PURPOSE MOP APPARATUS AND METHOD OF USE

(71) Applicant: Minh T. Dinh, Mira Loma, CA (US)

(72) Inventor: Minh T. Dinh, Mira Loma, CA (US)

( * ) Notice: Subject to any disclaimer, the term of this patent is extended or adjusted under 35 U.S.C. 154(b) by 127 days.

This patent is subject to a terminal disclaimer.

(21) Appl. No.: 13/766,360

(22) Filed: Feb. 13, 2013

Related U.S. Application Data

(63) Continuation-in-part of application No. 12/312,162, filed as application No. PCT/US2007/024351 on Nov. 23, 2007, now Pat. No. 8,397,338.

(60) Provisional application No. 60/860,669, filed on Nov. 22, 2006, provisional application No. 60/919,643, filed on Mar. 23, 2007, provisional application No. 60/962,235, filed on Jul. 27, 2007.

(51) Int. Cl.

| | |
|---|---|
| ***A47L 13/24*** | (2006.01) |
| ***A47L 13/255*** | (2006.01) |
| ***A47L 13/256*** | (2006.01) |
| ***A47L 13/58*** | (2006.01) |
| ***B08B 1/00*** | (2006.01) |
| ***A47L 13/20*** | (2006.01) |

(52) U.S. Cl.
CPC ..... *A47L 13/24* (2013.01); *A47L 13/20* (2013.01); *A47L 13/255* (2013.01); *A47L 13/256* (2013.01); *A47L 13/58* (2013.01); *B08B 1/001* (2013.01)

(58) Field of Classification Search
CPC ..... A47L 13/20; A47L 13/58; A47L 13/24; A47L 13/255; A47L 13/256; B08B 1/001
See application file for complete search history.

(56) References Cited

U.S. PATENT DOCUMENTS

| | | | | |
|---|---|---|---|---|
| 2,127,886 | A | | 8/1938 | Plon |
| 2,777,148 | A | * | 1/1957 | Belsky et al. ..... 15/228 |
| 3,562,841 | A | | 2/1971 | Royalty |
| D228,339 | S | | 9/1973 | Zemke |
| 3,991,431 | A | * | 11/1976 | Thielen ..... 15/147.2 |
| 4,580,307 | A | * | 4/1986 | Moss ..... 15/147.1 |
| 4,845,800 | A | | 7/1989 | Pederson et al. |
| 6,023,810 | A | | 2/2000 | Gessert |
| 6,425,705 | B1 | | 7/2002 | Ingram |
| 6,523,213 | B1 | | 2/2003 | Post |
| 6,560,815 | B1 | | 5/2003 | Brennan et al. |
| 6,795,999 | B1 | | 9/2004 | Post et al. |
| 7,150,063 | B1 | | 12/2006 | Graham |
| 2003/0182751 | A1 | | 10/2003 | White |
| 2006/0048318 | A1 | | 3/2006 | Goh et al. |

* cited by examiner

*Primary Examiner* — Randall Chin
(74) *Attorney, Agent, or Firm* — One3 IP Management, P.C.; Jeromye V. Sartain

(57) ABSTRACT

A multi-purpose mop apparatus includes a mop having a mop handle and a cleaning attachment removably mounted thereon, the mop handle further comprising a base and a grip installed thereon for manipulating the mop during use. The cleaning attachment may be a mop material cinched onto the base of the mop handle using a drawstring or may be a squeegee strapped thereto. A removable extension handle may be pivotally installed on the mop handle and configured for use in multiple configurations and modes.

20 Claims, 14 Drawing Sheets

MULTI-PURPOSE MOP APPARATUS AND METHOD OF USE

RELATED APPLICATIONS

This is a continuation-in-part application of a prior filed application having Ser. No. 12/312,162, now U.S. Pat. No. 8,397,338, and filing date of Apr. 27, 2009.

This application claims priority and is entitled to the filing date of U.S. Provisional application Ser. No. 60/860,669 filed Nov. 22, 2006, and entitled "Hand Mop," U.S. Provisional application Ser. No. 60/919,643 filed Mar. 23, 2007, and entitled "Handy Mop," U.S. Provisional application Ser. No. 60/962,235 filed Jul. 27, 2007, and entitled "Wringing Bucket Mop System," and U.S. Non-provisional application Ser. No. 12/312,162, now U.S. Pat. No. 8,397,338, filed Apr. 27, 2009, and entitled "Multi-Purpose Mop System and Method of Use." The contents of the aforementioned applications are incorporated herein by reference.

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to cleaning devices, and more particularly to mops.

2. Description of Related Art

The following art defines the present state of this field:

U.S. Pat. No. 2,127,886 to Plon discloses a stick-handled appliance for the care (mopping, cleaning, waxing or the like) of floors and stairs, the appliance being characterized by the fact that while the stick is attached by means of a removable stick fastening plate to the body of the appliance, the latter is provided on its upper side with a handle which protrudes through a slot in the stick fastening plate and at the same time forms part of a fastening device which provides an easily releasable attachment of the stick fastening plate to the body of the appliance, and which when released permits the removal of the stick fastening plate and the use of the appliance by means of the said grasp handle. The appliance is further advantageously provided with means enabling a cloth wrapped round the body of the appliance to be held when the appliance is used by means of the handle. These means comprise a cloth holding plate separate from the appliance, which is so constructed that after the stick fastening plate has been removed, it can be secured to the body of the appliance by the fastening device, in order to hold the cloth in its working position by clamping the ends of the cloth wrapped over the body of the appliance.

U.S. Pat. No. 3,562,841 to Royalty discloses a mop of the sponge-type material and a bucket provided with a squeeze plate for squeezing the mop. The mop and squeeze plate have a cooperating hook-type coupling about which the mop can be pivoted to squeeze it against the pressure plate by swinging the handle on the mop in an arcuate path.

U.S. Pat. No. D228,339 to Zemke discloses a design for a pad holding device.

U.S. Pat. No. 4,845,800 to Pederson et al. discloses a mop having an elongated mop head fabricated in sections, with each section being connected by a hinge to the adjoining sections on either side. The outermost sections can be rotated upward independently about their respective hinges so that they lie flat and inverted on the adjacent inner sections, forming a mop with a narrower mop head. The two outer sections thus folded on either side can again be rotated upward about the next hinge to lie flat and inverted on the adjoining inner section, with the outer section nested between the other sections in this folded position. By thus folding the various sections the mop head can be adjusted to a variety of lengths. A locking mechanism at each hinge causes each pair of sections to lock in either the extended or folded positions. The mop handle is attached to the center mop head section by means of a universal-type joint. A removable swab is further provided for the mop head.

U.S. Pat. No. 6,023,810 to Gessert discloses a grill cleaning apparatus including a body for detachably retaining a scouring pad. The body is provided with a "grasp" that may be grabbed by one or both hands to manipulate the body and scouring pad on a surface that requires cleaning. Alternatively, an elongated handle may be detachably and adjustable secured to the "grasp" so as distance the operator's hands from a hot grill that requires cleaning. Detachable tine means are mounted on the body and are manipulable to enable application of a scouring pad on the tine means, or removal of a scouring pad therefrom.

U.S. Pat. No. 6,425,705 to Ingram discloses a ratchet-like coupling mechanism (20) for releaseably coupling a cleaning head (22) to a handle (24). The mechanism (20) comprises a handle adaptor (28), a sleeve (30), an engagement arm (32), and an engagement wheel (34). Where a liquid delivering handle (24) is used, the handle adaptor (28) operates to adapt the mechanism (20) to avoid interfering with the liquid flowpath. The handle adaptor (28) may be eliminated where a solid handle is used. The sleeve (30) secures to the handle adaptor (28) or directly to the handle, and supports the engagement arm (32). The engagement wheel (34) is secured to the head (22). The arm (32) and wheel (34) present oppositely biased teeth (56,57) allowing the adaptor (28) or handle to be threadably coupled with the head (22), but which must be disengaged, by actuating the arm (32), to uncouple the head (22) from the handle (24).

U.S. Pat. No. 6,523,213 to Post discloses a window cleaning apparatus which includes a handle, a paddle and a cleaning element. The paddle is removably attachable to the handle. The cleaning element is one of a plurality of interchangeable bodies, each having one major surface engagable with one major surface of a paddle and side edges having elastic mounted thereon to draw the ends of the side edges of the body inward to form an opening smaller than the outer diameter of the paddle to releasably attach the cleaning element about the paddle. A first pair of receivers are mounted on each paddle and pivotally receive one end of the handle. A second pair of receivers, mounted in conjunction with the first pair of receivers on a paddle or as a separate element on a paddle, receive a second handle. In one aspect, the cleaning apparatus forms a cleaning system including a plurality of handles, a plurality of paddles and a plurality of cleaning elements releasably interconnectable into a cleaning apparatus formed of one handle, one cleaning element and one paddle.

U.S. Pat. No. 6,560,815 to Brennan et al. discloses a mop squeezing device provided for co-operation with a mop head of a mop (49). The mop (49) has a mop head backing (53) which carries mop material (55). The device has a mop surface engaging face (17) and displaced opposite said face (17) abutment means (19). In use the mop head is placed between the mop surface engaging face (17) and the abutment means (19) and the handle of the mop cranked. This, in turn, compresses the mop material (55) and squeezes liquid from the mop material (55). A mop having a backing for mop material is also provided. A two-axis swivel connector is provided between the mop head and a mop handle. This allows the mop head to assume multi-axis of orientation during operation U.S. Patent Application Publication No. 2003/0182751 to White discloses a faux painting tool including a tubular handle, planer body and an application surface. The handle is rotatable and extendable to provide versatility and user comfort. The handle rotates about a first end having a circular dowel rotatably engaged by two spaced parallel couplings. A second end of the handle is removably engaged by a semi-circular carrier member having an opening for insertion of a portion of the handle. A telescoping elongated unit is slidably positioned over the tubular handle. Pressing spring biased pins permits the telescoping unit to be adjusted along a length of the tubular handle thereby lengthening the handle. A handle end includes a threaded aperture for receiving a threaded pole extension. Application material, including lamb's wool, is removably attached to a body of the tool by means of hook and loop fasteners attached to the material and a back surface of the tool's body.

U.S. Pat. No. 6,795,999 to Post et al discloses a window cleaning apparatus which includes a handle, a paddle and a cleaning element. The paddle is removably attachable to the handle. The paddle has a peripheral edge defined in part by opposed first and second ends. The paddle has an arcuate shape between the first and second ends. The cleaning element is one of a plurality of interchangeable bodies, each having one major surface engagable with one major surface of a paddle and side edges having elastic mounted thereon to draw the ends of the side edges of the body inward to form an opening smaller than the outer diameter of the paddle to releasably attach the cleaning element about the paddle. In one aspect, the cleaning apparatus forms a cleaning system including a plurality of handles, a plurality of paddles and a plurality of cleaning elements releasably interconnectable into a cleaning apparatus formed of one handle, one cleaning element and one paddle.

U.S. Patent Application Publication No. 2006/0048318 to Goh et al. discloses a cleaning implement provided for cleaning surfaces with a cleaning substrate. The cleaning implement includes a handle connected via a universal joint to a mop head. The mop head includes a bumper pad, which is made of a deformable and nonabsorbent material. The bumper pad can be deformed in the Z direction and within the X-Y plane. The cleaning implement can also include a motor for causing a portion of the mop head to move relative to the handle.

U.S. Pat. No. 7,150,063 to Graham discloses a vehicle washing mitt for covering vehicle washing brushes, such as those at self-service car washes. The mitt is shaped to effectively cover the vehicle washing brush while it is in use. The material used to form the mitt has a soft fibrous external outside and is secured on to the brush with a fastener. Methods of washing a vehicle by using the mitt are also disclosed.

The prior art described above teaches a stick-handled appliance for the care of floors and stairs, a mop and wringing bucket combination, a pad holding device, a folding mop, a grill cleaning apparatus incorporating detachable handle and holder for removable scouring pad, a ratchet mechanism for connecting a cleaning head to a handle, a vehicle window cleaning apparatus and system, a mop squeezing device, a faux painting tool, a cleaning apparatus and system, a multi-surfaces cleaning implement, and a vehicle wash mitt, but does not teach a multi-purpose mop system including a mop with selectively removable cleaning materials and extension handle and a specially configured bucket with a multi-position bucket handle for effectively working in conjunction with and wringing the mop. Aspects of the present invention fulfill these needs and provide further related advantages as described in the following disclosure.

SUMMARY OF THE INVENTION

Aspects of the present invention teach certain benefits in construction and use which give rise to the exemplary advantages described below.

The present invention solves the problems described above by providing an improved multi-purpose mop apparatus and method of use. The apparatus provides, in the exemplary embodiment, a mop handle having a base and a grip installed thereon for manipulating the mop during use, the grip being formed with opposite holes, a cleaning attachment removably mounted on the base, and an extension handle selectively attached to the mop handle, the extension handle having a lengthwise gripping rod and a pair of legs extending from an end of the rod and formed at the distal ends thereof with tines configured for seating in the holes formed in the grip, the legs being further formed with intermediate bends, whereby in a first operable configuration with the bends in the legs substantially toward the grip, the extension handle is pivoted away from the grip in a first mode of operation and the extension handle is pivoted toward the grip such that the legs are brought substantially adjacent to the grip in a second mode of operation, thereby enabling simultaneous grasping of the grip and at least one of the legs of the extension handle for manipulation of the mop apparatus through the grip without removal of the extension handle.

A primary objective inherent in the above described apparatus and method of use is to provide advantages not taught by the prior art.

Another objective is to provide such an apparatus that allows for operation of the mop handle with or without the extension handle.

A further objective is to provide such an apparatus that allows for operation in multiple modes when the extension handle is selectively and removably engaged with the mop handle.

A still further objective is to provide such an apparatus that allows for simultaneous grasping of the grip of the mop handle and at least one of the legs of the extension handle for manipulation of the mop apparatus through the grip without removal of the extension handle.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
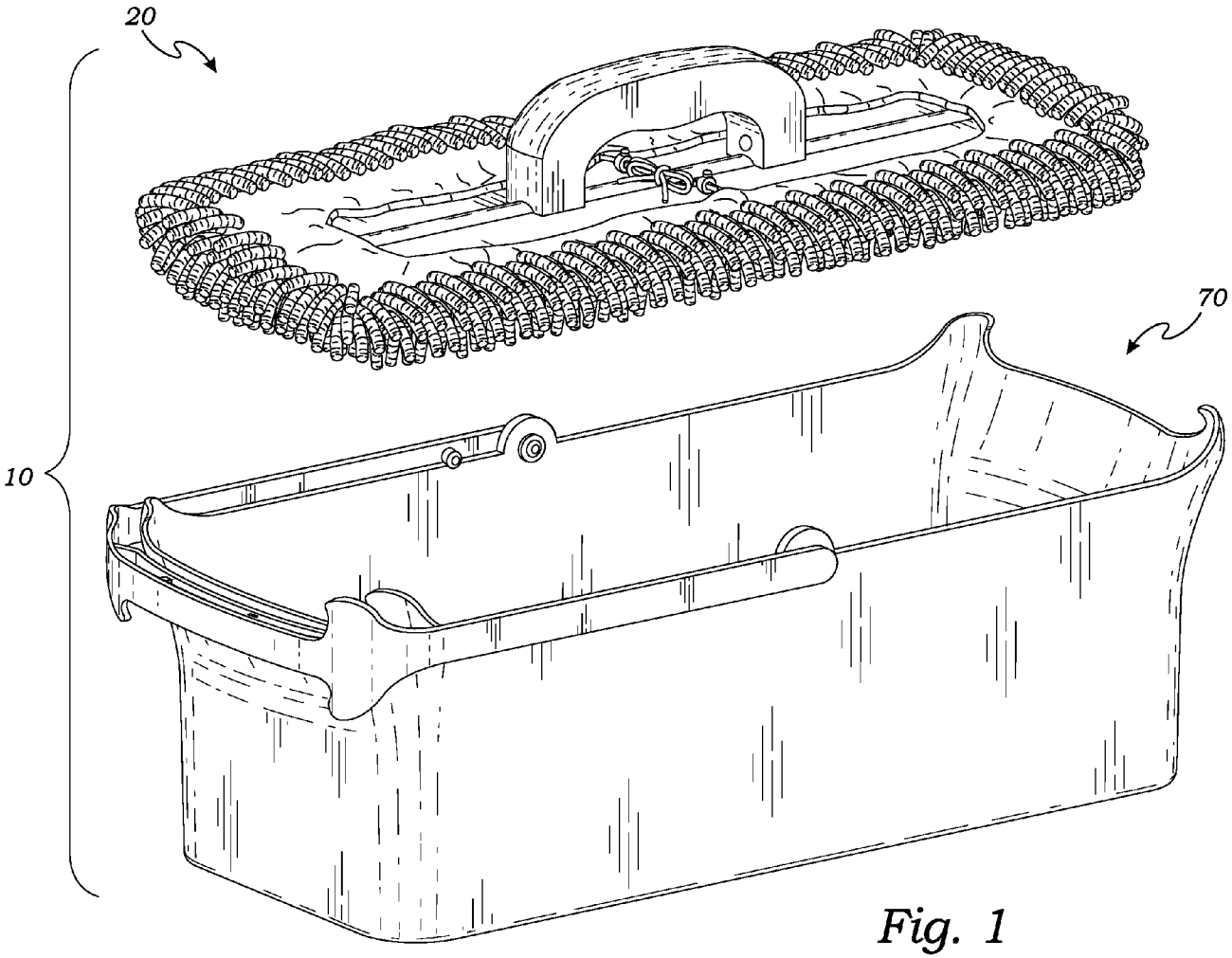
FIG. 1 is a perspective view of an exemplary embodiment of the mop system of the present invention.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Aspects of the present invention are generally directed to a multi-purpose mop system including a mop with selectively removable cleaning materials and extension handle and a specially configured bucket with a multi-position bucket handle for effectively working in conjunction with and wringing the mop. As compared to prior art mops and mopping systems, the multi-purpose mop system of the present invention offers increased versatility and convenience in use by providing new and improved functionality for wet or dry cleaning of a variety of objects and surfaces, including but not limited to vehicles, countertops, shower and baths, windows, floors, and the like. While particular embodiments of such an improved mop system are shown and described, it will be appreciated by those skilled in the art that the present invention is not so limited, but may include or incorporate functionally equivalent materials and construction now known or later developed without departing from the spirit and scope of the invention. Throughout the written description and figures, like reference numerals are employed in referring to related features or elements in the various alternative exemplary embodiments (for example, at least six exemplary embodiments of a mop handle according to aspects of the present invention are shown and described herein and so are numbered 30, 130, 230, 330, 430 and 530).

Referring first to FIG. 1, there is shown a perspective view of an exemplary embodiment of the multi-purpose mop system 10 including a mop, generally denoted 20, and a bucket, generally denoted 70. More details about the construction of both the mop 20 and the bucket 70 follow in connection with FIGS. 2-14 and 15-17, respectively. In general, it will be appreciated that the size and shape of the bucket 70 complements that of the mop 20, such that the bucket 70 is configured to receive the mop 20, as in the case of wet mopping. It will be further appreciated that the relatively large, rectangular shape, or "footprint," of the mop 20 further enhances its performance during use. However, those skilled in the art will appreciate that while particular shapes of the mop 20 and bucket 70 are shown and described, other complementary shapes to suit particular applications may also be employed without departing from the spirit and scope of the invention. For example, the mop 20, and correspondingly the bucket 70, may be triangular or circular in cases where corners, and hence the ability to clean into corners, is more or less desirable or needed.

Figure 2:
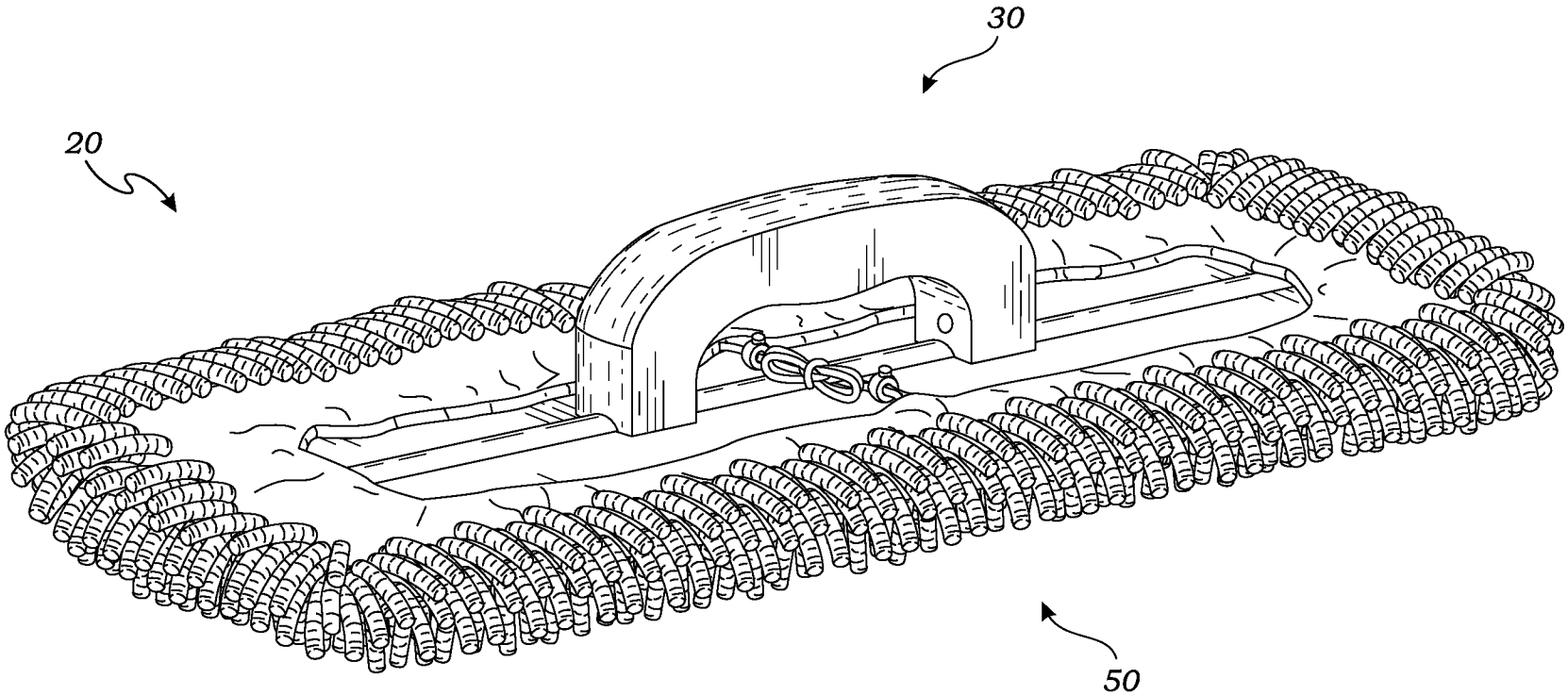
FIG. 2 is a perspective view of a mop thereof.
Figure 3:
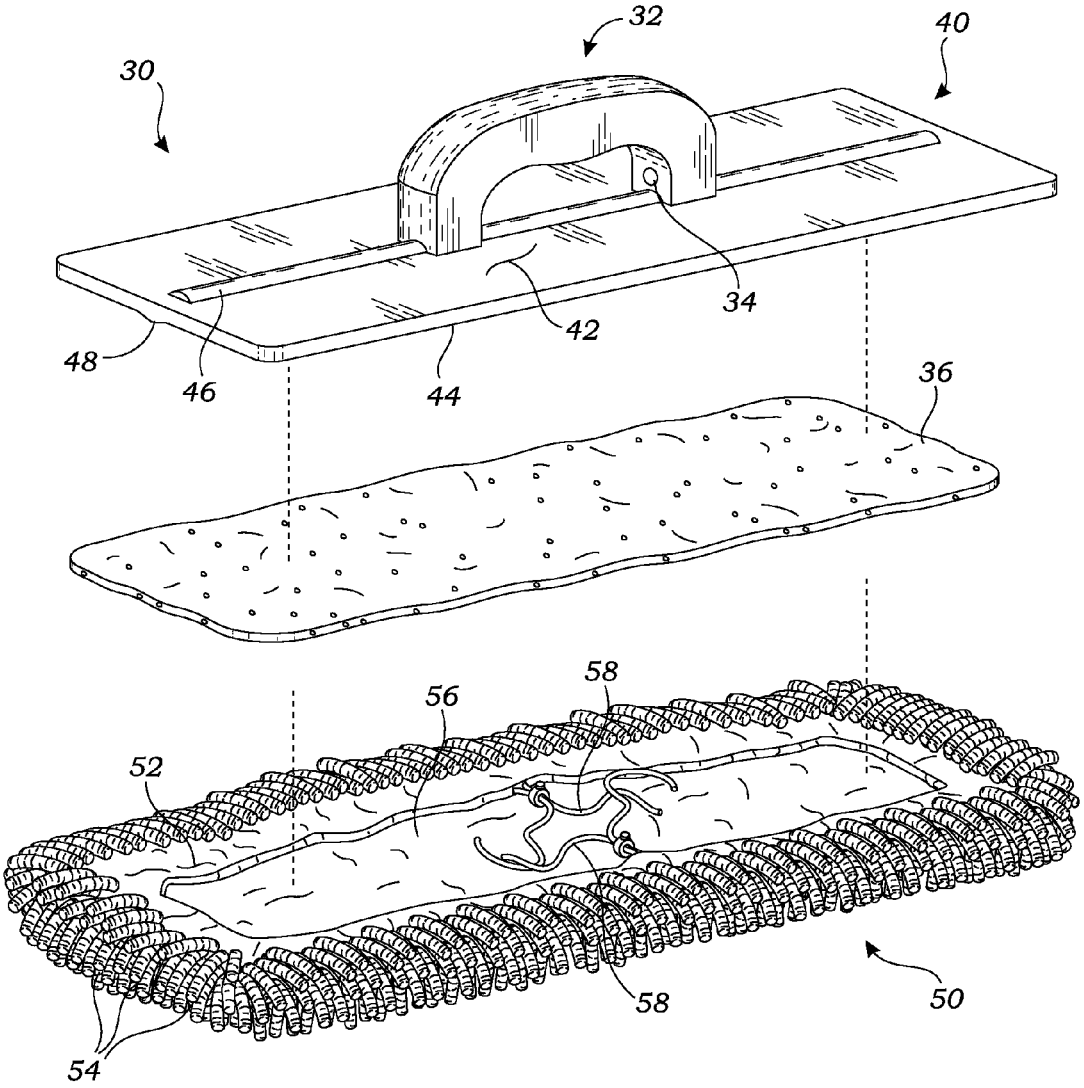
FIG. 3 is an exploded perspective view of the mop thereof.

Turning to FIGS. 2 and 3, there are shown assembled and exploded perspective views of the exemplary mop 20 of the present invention. The mop 20 generally comprises a mop handle 30 and a cleaning attachment 50, which components are selectively engaged for particular uses as explained more fully below. The mop handle 30 in the exemplary embodiment includes a grip 32 mounted on a substantially planar, rectangular base 40. Again, it will be appreciated by those skilled in the art that various other shapes and configurations of the grip 32, as shown and described, for example, in connection with the alternative mop handle embodiments of FIGS. 5-7, and of the base 40 are possible in the present invention depending on the context. As such, specifically, it will be appreciated that while the base 40 is shown as being substantially planar and rectangular, many other configurations can be employed without departing from the spirit and scope of the invention. In the exemplary configuration of the handle 30, the grip 32 is formed as a somewhat U-shaped member attached at two points along the top surface 42 of the base 40 so as to be oriented substantially along the long axis of the base 40. The grip 32 may be sized and contoured so as to be ergonomic and comfortable, as is known in the art. It will be appreciated that the symmetrical construction of the grip 32 and its substantially central location along the base 40 enable convenient use of the mop 20 when grasped from either direction or by a right- or left-handed user. The grip 32 may also be formed along one or more surfaces with at least one hole 34 for the purpose of removable attachment of an extension handle 60, more about which is said below in connection with FIGS. 8-14. The base 40 of the handle 30 may be further formed along one or both of its top and bottom surfaces 42, 44 with a spine or rib 46, 48, respectively, to provide further lateral stiffness to the base 40, and hence the handle 30 and the entire mop 20, during use. The ribs 46, 48 may extend the entire length of the base 40 or may be shorter or broken up, as by the grip 32 formed on the top surface 42 of the base 40 (see FIG. 14, discussed below). In addition, a further spine (not shown) may be formed about the perimeter of the base 40 to increase stiffness and structural integrity and potentially further aid in removably securing the cleaning attachment thereto. It will be appreciated by those skilled in the art that the grip 32 and the base 40, including its top and bottom ribs 46, 48, and any other spines or features, may be formed as a single, integral unit as through a molding or machining process, or may be formed as separate components and subsequently assembled using any assembly means now known or later developed in the art. Accordingly, it will be further appreciated that the handle 30 may be made of one or more materials of a variety of types depending on the application, including but not limited to, plastic, metal and wood.

With continued reference to FIGS. 2 and 3, the cleaning attachment 50 is shown in the exemplary embodiment as a chenille micro-fiber mop material having a fabric substrate 52 with a plurality of micro-fiber cleaning elements 54 affixed thereto and flexibly protruding therefrom using any means of fabrication now known or later developed. As will be appreciated, the mop material 50 is sized and shaped to substantially conform to and so be removably attached to the handle 30. As such, in the exemplary embodiment, the mop material 50 has a substantially rectangular profile, or "footprint," corresponding to that of the handle 30, and particularly the base 40. To facilitate removable attachment of the mop material 50 onto the handle 30 for use, the fabric substrate 52 may be formed effectively having a pocket 56 open at the top, whereby the base 40 of the handle 30 may be inserted into the pocket 56 of the substrate 52 such that the perimeter of the base 40 is bounded by the pocket 56. To then secure the base 40 within the pocket 56 of the fabric substrate 52, and so attach the mop material 50 to the handle 30 for use, one or more attachment means 58, here configured as drawstrings with locking clamps, may be formed or installed on the substrate 52 substantially about or spanning the opening into the pocket 56. To secure the mop material 50 onto the handle 30 employing the exemplary drawstrings 58, it will be appreciated that the drawstrings may simply be pulled tight to take out any slack and then tied together and/or locked in such cinched position using slidable, spring-biased clamps as are known and used in the art. Those skilled in the art will again appreciate that while a particular construction of the mop material 50 and the means for removably attaching the mop material 50 to the handle 30 are shown and described, numerous other configurations, materials and fastening means, both now known and later developed, are possible in the present invention without departing from its spirit and scope. For example, rather than using drawstrings 58, the mop material or other cleaning attachment 50 may be removably attached to the mop handle 30 though hook-and-loop fasteners, snaps, and other such temporary securing means now known or later developed. By way of further example, while the mop material 50 is shown and described as entailing a chenille microfiber fabric, it will be appreciated that any suitable fabric now known or later developed may be employed as having sufficient properties in the mop 20, depending on the application, such properties relating to use wet or dry, absorption, dust and dirt attraction, washability, durability, low abrasiveness, etc. Finally, there is also shown in FIG. 3 an optional foam pad 36 that may be installed between the rigid or semi-rigid handle 30 and the mop material 50, substantially adjacent the bottom surface 44 of the handle's base 40, so as to provide a further buffer between the handle 30 and the surface being cleaned in addition to the mop material or other cleaning attachment 50 itself. This pad 36 may be formed of any suitable material now known or later developed and, once more, may be sized and configured to complement the configurations of the handle 30 and mop material 50. Moreover, it will be appreciated that the pad 36 may be simply laid within the pocket 56 of the mop material 50 before the mop material 50 is then attached to the handle 30, and so held in place during use simply by way of the pocket's inside perimeter, may be permanently installed in the pocket 56, or to the fabric substrate 52, or on the bottom surface 44 of the handle base 40 as by any means now known or later developed, including but not limited to stitching, ultrasonic welding, or solvent bonding or other such adhesive, or may be removably attached to the fabric substrate 52 or the bottom surface 44 of the handle base 40 as by any means now known or later developed, including but not limited to hook-and-loop fasteners, snaps, or non-permanent adhesive.

Figure 4:
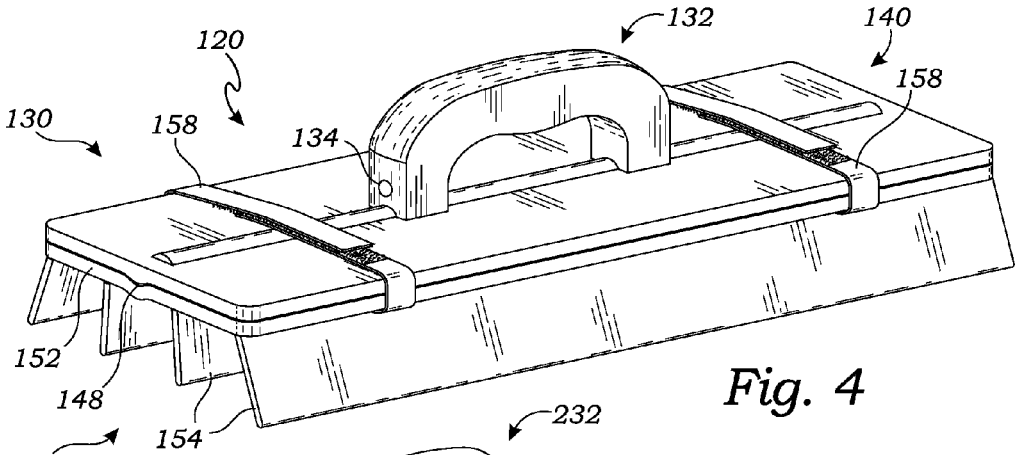
FIG. 4 is a perspective view of an alternative embodiment of the mop thereof.

Turning now to FIG. 4, there is shown an alternative exemplary embodiment of the mop 120 of the present invention wherein a cleaning attachment configured as a squeegee 150 for removing or controlling the flow of liquid on a flat surface, such as water on a window, is removably attached to the mop handle 130. Here, the squeegee 150 is shown as being attached to the base 140 of the handle 130 by way of two pairs of hook-and-loop fastener straps 158. The squeegee may include a substrate 152 that is installed substantially adjacent to the bottom surface of the base 140. More particularly, the substrate 152 may be formed having a contour substantially complementing that of the base's bottom surface, whereby the substrate 152, and hence the squeegee 150 is keyed or laterally stabilized relative to the handle 130, which would provide benefits in use as the squeegee is moved over a surface to be wiped. In the exemplary embodiment, then, the squeegee is formed on the upper surface of its substrate 152 with a lengthwise channel substantially conforming to the lengthwise rib 148 of the base 140. It will be appreciated by those skilled in the art that a number of other means for positively keying or locating the squeegee 150 relative to the handle 130 when it is removably installed thereon may be employed, including but not limited to instead forming a notch in the bottom surface of the handle base 140 and a matching rib on the upper surface of the squeegee's substrate. As with the pad 36 and mop material 50 discussed above, the squeegee 150 may also be removably or even permanently attached to the handle 130 using any means now known or later developed in the art, such that the invention is not limited to the particular attachment and keying means shown and described. From the side of the squeegee's substrate 152 opposite the handle 130, there extend one or more cleaning elements here in the form of flexible blades 154 at various angles to the substrate 152 depending on the application. It will be appreciated that the blades 154 may be made of rubber, plastic or any other such material suitable for removing or controlling the flow of liquid on a flat surface as are generally known in the art. The blades 154 may be installed on the substrate 152 during a secondary operation involving any assembly technique now known or later developed or may be formed integral with the substrate as through a molding or extruding process. It will be appreciated by those skilled in the art that a variety of configurations, materials and constructions of the squeegee 150 may thus be employed without departing from the spirit and scope of the invention. Referring again to the alternative handle 130, the one or more holes 134 are here configured on an outside surface of the grip 132 for removable attachment thereby of an alternative extension handle 160 as will be appreciated from the below discussion in connection with FIG. 13.

Figure 5:
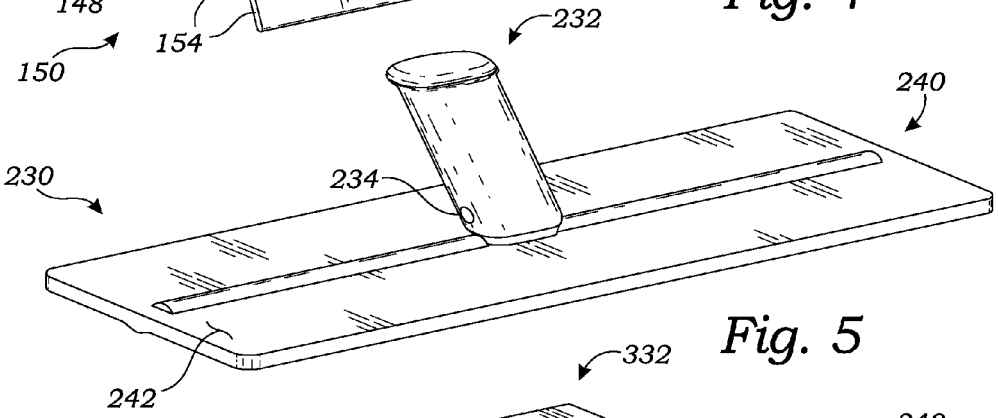
FIG. 5 is a perspective view of an alternative embodiment of a mop handle of the mop thereof.
Figure 6:
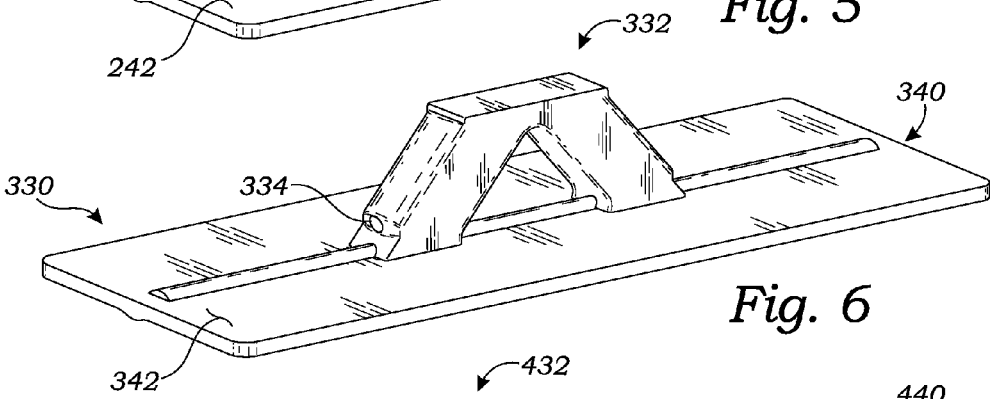
FIG. 6 is a perspective view of a further alternative embodiment of a mop handle of the mop thereof.
Figure 7:
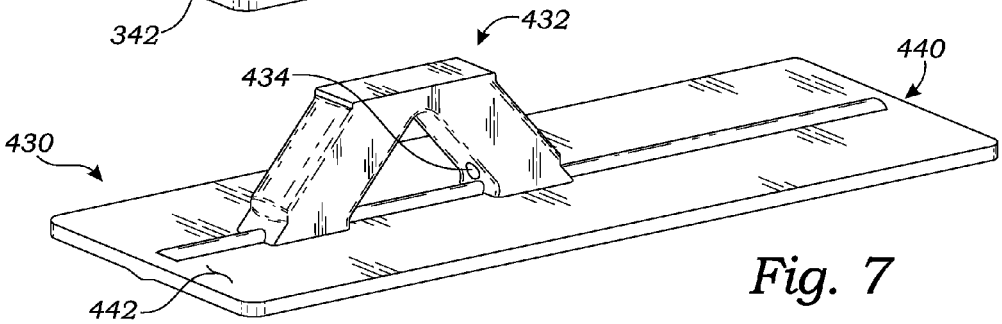
FIG. 7 is a perspective view of a still further alternative embodiment of a mop handle of the mop thereof.

Referring now to FIGS. 5-7, there are shown perspective views of three further alternative embodiments of a mop handle according to the present invention. First, in FIG. 5 there is shown a mop handle 230 wherein a grip 232 configured as a post is mounted on or integral with the base 240. The post 232 is shown as extending from the top surface 242 of the base 240 and substantially centered on the base 240 at an oblique angle, or not perpendicular, relative thereto, though those skilled in the art will appreciate that such a post 232 may be mounted in various locations and at various orientations on the base 240 and still be conveniently grasped and manipulated by a right- or left-handed user. In FIG. 6 there is shown a further exemplary mop handle 330 wherein a somewhat V-shaped grip 332 is attached at two points along the top surface 342 of the base 340 so as to be oriented substantially along the long axis of the base 340. The grip 332 may again be sized and contoured so as to be ergonomic and comfortable. It will be appreciated that the symmetrical construction of the grip 332 and its substantially central location along the base 340 enable convenient use of the mop when grasped from either direction or by a right- or left-handed user. Finally, in FIG. 7 there is shown a still further exemplary embodiment mop handle 430 similar to that of FIG. 6, but wherein the V-shaped grip 432 is now offset on the top surface 442 of the base 440, as may be desirable in certain applications or uses. Once more, it will be appreciated that any such handle grip may be mounted in various locations and at various orientations on the base and still be conveniently and effectively grasped during use. The handles 230, 330, 430, and grips 232, 332, 432, particularly, are shown in FIGS. 5-7 with holes 234, 334, 434, respectively, again for removably attaching an extension handle, and it will be further appreciated that any such alternative handle designs may also be formed with any appropriate structure, including but not limited to properly located holes, for the purpose of removable attachment of an extension handle, more about which again is said below in connection with FIGS. 8-14.

Figure 8:
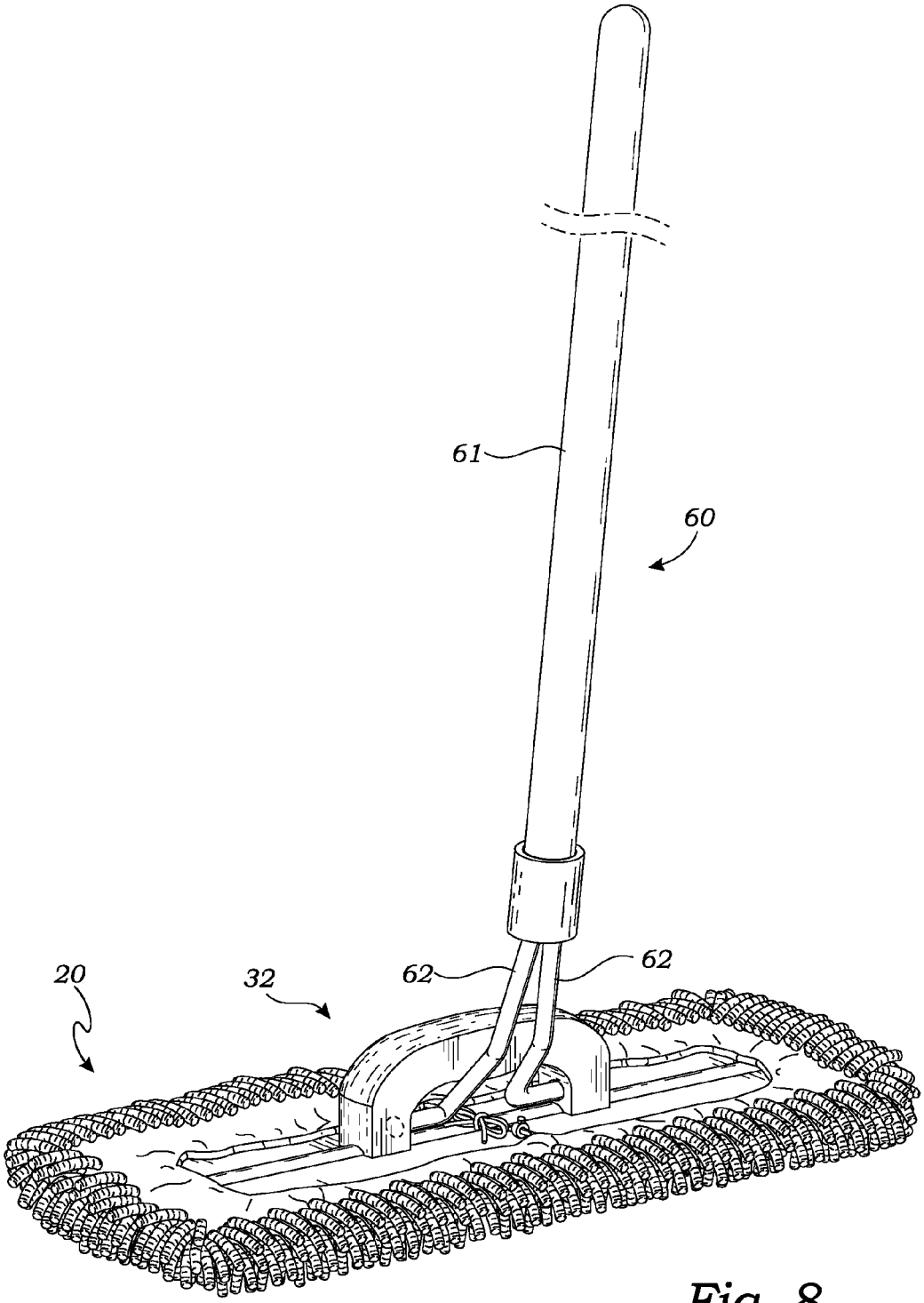
FIG. 8 is a perspective view of the mop of FIGS. 1-3 having an extension handle removably installed thereon.
Figure 9A:
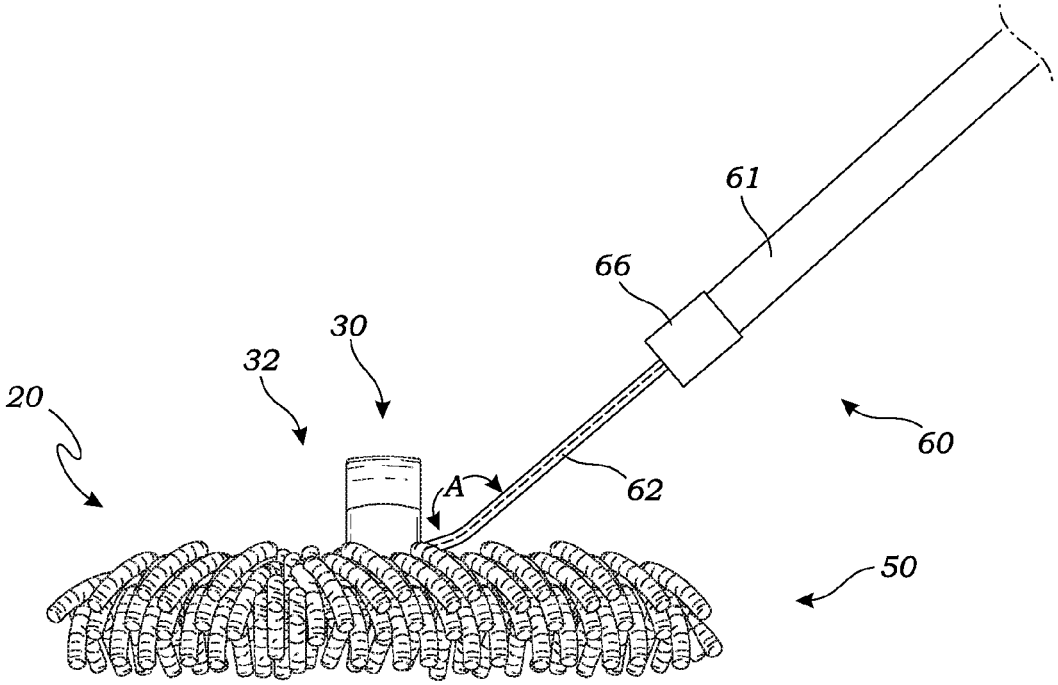
FIG. 9A is a partial side view thereof in a first configuration and first mode of operation.
Figure 9B:
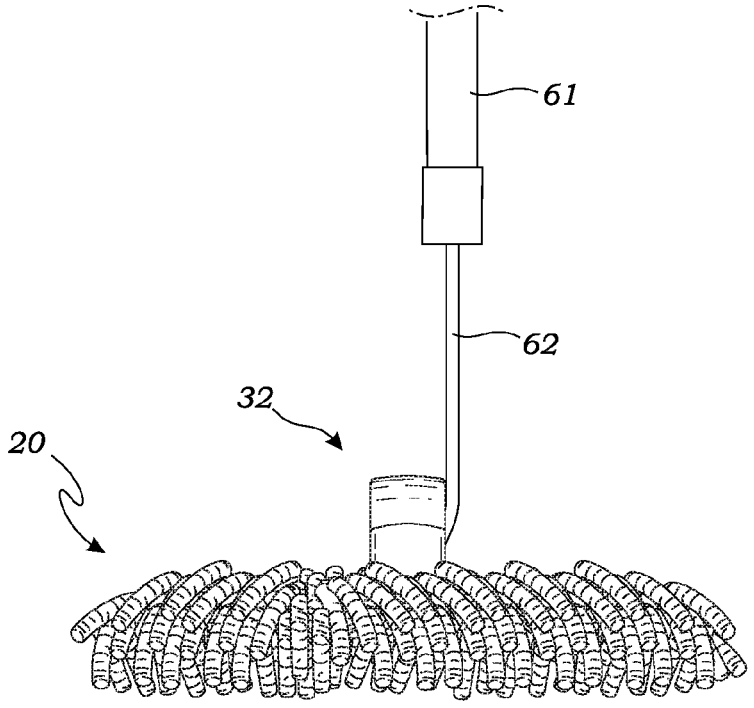
FIG. 9B is a partial side view thereof in the first configuration and a second mode of operation.
Figure 10:
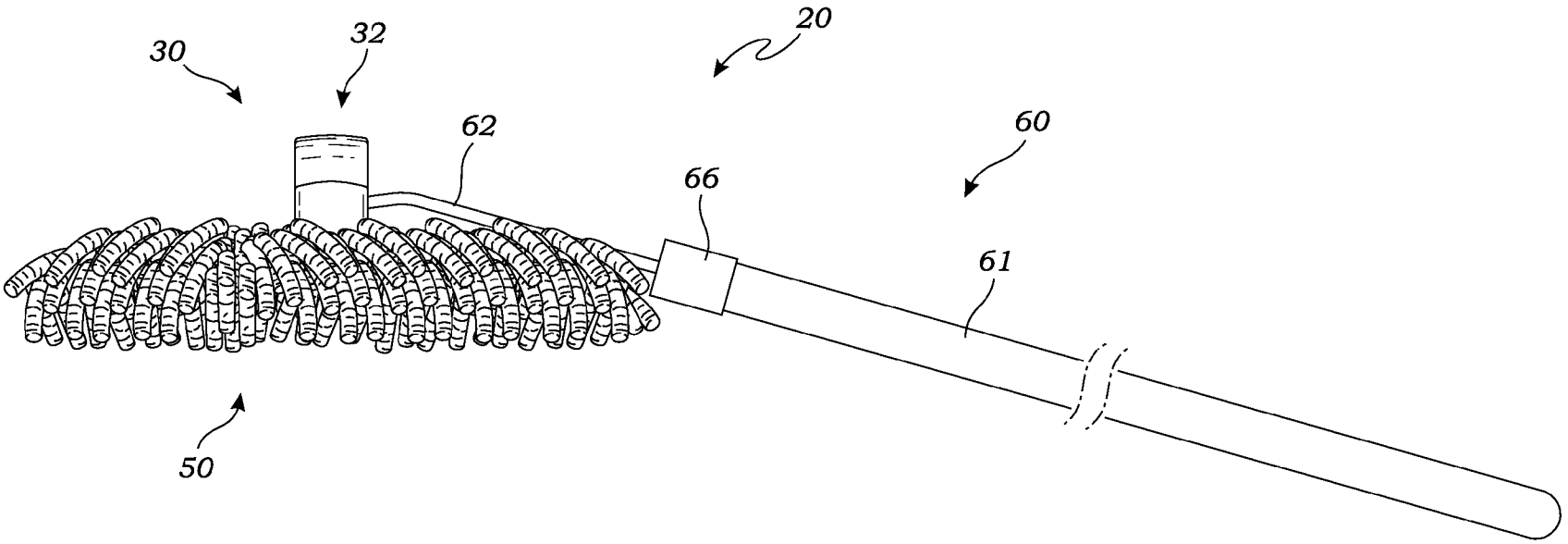
FIG. 10 is a partial side view thereof in a second configuration and third mode of operation.

Turning to FIGS. 8-12, there is shown a first exemplary embodiment of an extension handle 60 removably attached to the exemplary mop 20 shown in FIGS. 1-3. The extension handle 60 generally comprises a rod 61 of whatever length is desirable and a pair of somewhat resilient legs 62 extending from one end thereof. The legs 62 are formed at their distal ends with respective outwardly-projecting tines 63 (FIG. 11) configured to engage the holes 34 formed in the handle grip 32 of the mop 20 so as to removably and pivotally attach the extension handle 60 to the mop 20. As best seen in the side view of FIG. 9A, the legs 62 are preferably formed in this exemplary embodiment with a slight intermediate bend along their length as indicated by angle "A", whereby the extension handle 60, when attached to the mop 20 as shown in FIG. 8, is yet capable of pivoting upwardly to a position such that the gripping rod 61 portion of the extension handle 60 is substantially perpendicular to the plane of the mop handle's base 40 and pivoting downwardly to a position such that the gripping rod 61 is approximately sixty degrees (60°) from vertical or approximately thirty degrees (30°) from horizontal (e.g. a floor or other such surface being cleaned), thus having a range of motion or arc of the extension handle 60 relative to the mop 20 from effectively thirty to ninety degrees (30-90°) so as to thus operate as needed in cleaning surfaces of virtually any orientation. More particularly, while the handle grip 32 on the mop handle 30 limits the rotational swivel of the extension handle 60 to effectively a ninety degree (90°) arc, the additional bends "A" formed in the legs 62 that allow the legs 62, and thus the extension handle 60, to fold up to the handle grip 32 and stand substantially upright also act as a back stop against the handle base 40 when the extension handle is pivoted in reverse to a down position. This bend "A" in the legs 62 thus limits the true swivel of the extension handle 60 to approximately a sixty degree (60°) arc. This approximately sixty degree (60°) limit in pivotal movement also limits the rocking of the mop handle 30 and allows the handle 30 to be conveniently and consistently positioned on its base 40, or positioning of the cleaning attachment 50 adjacent to the surface to be cleaned, after the mop apparatus 20 is lifted off the surface. In contrast, the swivel of other mops of approximately one hundred-eighty degrees (180°) can become problematic when the mop is lifted and attempted to be repositioned on the surface to be cleaned, sometimes landing on the corner rather than the desired flat base. Other swivel mops therefore often require additional attention and effort to control the mop. In the exemplary embodiment, the bend "A" formed in the legs 62 is approximately ten degrees (10°) and is located along the lengths of the respective legs 62 so as to roughly correspond to the top surface of the grip 32 when the extension handle 60 is pivoted in that direction, as best seen in FIG. 9B. As such, when the extension handle 60 is removably installed on the mop 20 as by engaging the tines 63 (FIG. 11) of the legs 62 with the holes 34 (FIG. 3) formed in the grip 32 of the mop handle 30 in a first configuration as shown generally in FIG. 8 such that the bend "A" of the legs 62 is oriented substantially upwardly or toward the grip 32, in a first mode of operation as shown in FIG. 9A, the mop 20 may be conveniently operated to clean or mop a horizontal surface such as a floor, whereby the mop 20, and particularly the mop handle 30 and mop material 50, are substantially parallel to the floor or other surface to be cleaned and the extension handle 60, and particularly the gripping rod 61, is at a convenient angle for upright use and operation (for example, approximately forty-five degrees (45°) as shown). Moreover, it will be appreciated that the slight bend "A" in the legs 62 serves to direct the force exerted on the gripping rod 61 of the extension handle 60 slightly more horizontally, or in the direction the mop 20 is being pushed and pulled along a horizontal surface, thereby imparting more force or providing increased leverage for scrubbing and cleaning. And as shown in FIG. 9B, when it is desired to pivot the extension handle 60 substantially vertically, as when the mop 20 is to be wrung out or the grip portion 32 is to be grasped for further increased leverage against stuck-on dirt or other material that is to be cleaned from a surface, all while not removing the extension handle 60 from the mop handle 30, this is accomplished due to the bend "A" formed in the legs 62, allowing the legs 62 to substantially nest against the grip 32 in this alternative second mode of operation. Specifically, it will be appreciated in connection with the wringing operation shown in FIG. 18 that if the extension handle 60 were to remain attached, its ability to pivot to substantially vertical also brings the extension handle 60, and particularly the legs 62, substantially flush with the grip 32 so that both can grasped simultaneously for stability and for clearance of the extension handle 60 as the mop 20 is passed through the basin and handle channels 82, 102 during the wringing operation. Once again, the same is true of grasping the legs 62 and grip 32 simultaneously when the handle 30 is to be employed directly in scrubbing or cleaning a surface, yet once more conveniently without having to remove the extension handle 60. The minimal surface area of the legs 62 further aids in the performance of the mop 20, minimizing unwanted water retention in wet use and, as a result, corrosion of the parts. Turning to FIG. 10, there is shown a side view of the mop 20 in a second configuration now with the extension handle 60 installed such that the bend "A" of the legs 62 is oriented substantially downwardly or away from the grip 32. Thus, when the extension handle 60 is pivoted away from the mop handle 30, and particularly the grip 32 as in a third mode of operation, it will be appreciated that the orientation and location of the bend "A" allows the extension handle 60, and particularly the gripping rod 61, to extend past horizontal or effectively below the mop handle 30 and mop material 50. It will thus be further appreciated that the intermediate bend "A" in the legs 62 is particularly helpful in this second configuration for using the mop 20 to reach relatively high or overhead horizontal surfaces with the mop 20, such as vehicle roofs or the tops of large furniture items, by again simply reversing the attachment of the extension handle 60 relative to the grip 32. Those skilled in the art will thus appreciate that the mop 20 of the present invention offers tremendous versatility in use as well as control and stability, with the rocking and gravitational/inertial effects of the mop handle 30 on the extension handle 60 serving to effectively insure the substantially downward or horizontal orientation of the mop handle 30, and particularly the base 40 and cleaning attachment 50, during virtually all uses. In fact, the grip portion 32 of the mop handle 30 effectively acts as a counterweight, providing further stability and horizontal biasing of the mop handle 30 during use on the extension handle 60. And when a vertical surface such as a wall or window is to be cleaned, the extension handle 60 is simply rotated roughly ninety degrees such that the mop handle 30, and again particularly the base 40 and cleaning attachment 50, are then oriented substantially vertically as well, with the grip 32 once more acting as a counterweight of sorts to bias the base 40 vertical about the pivot points of the legs 62. It will be appreciated by those skilled in the art that all such angles, both of the bend "A" of the legs 62 and of the pivot through which the extension handle 60 moves, are merely illustrative of aspects of the present invention and non-limiting; rather, other angles and associated structure may be employed in the mop apparatus 20 of the present invention without departing from its spirit and scope.

Figure 11:
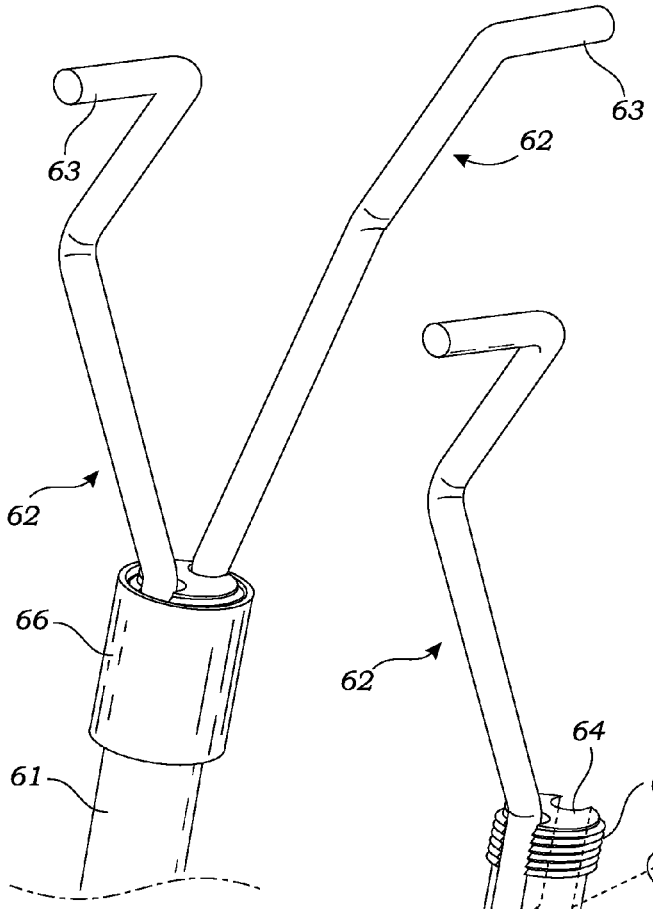
FIG. 11 is an enlarged partial perspective view of the extension handle thereof.
Figure 12:
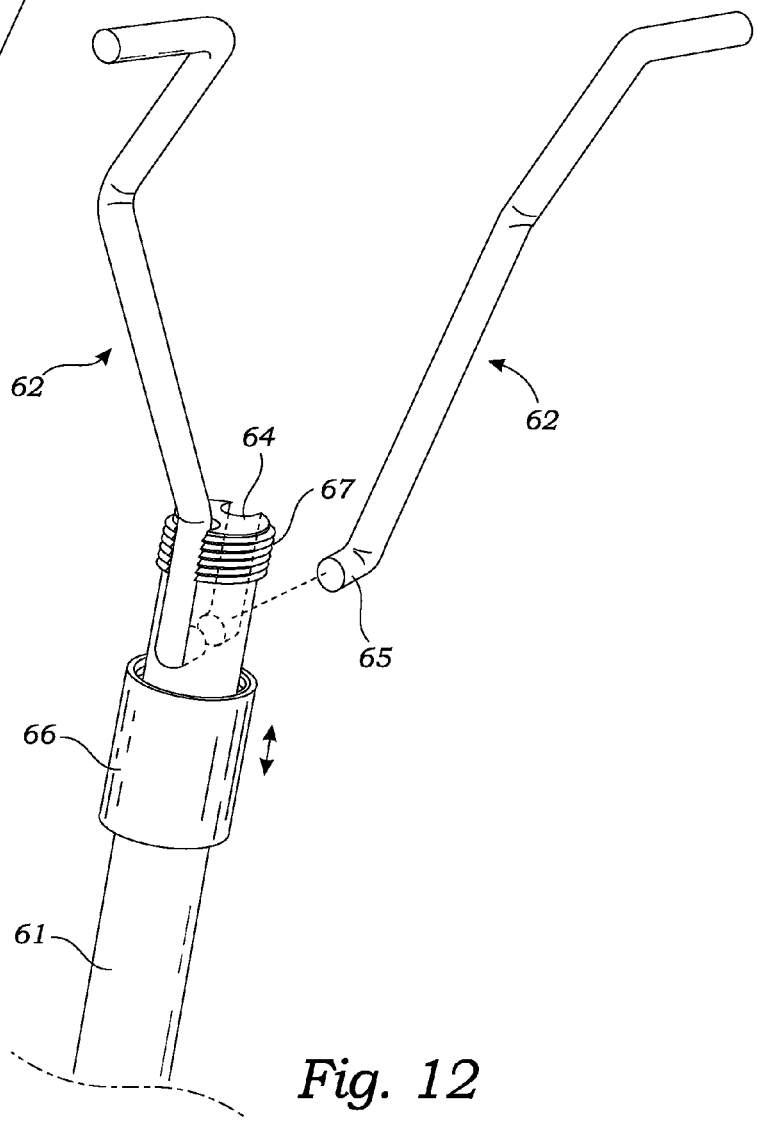
FIG. 12 is an exploded perspective view thereof.

With reference to FIGS. 11 and 12, in the exemplary embodiment, the legs 62 are formed as separate components that are then installed on the rod 61. As such, opposite notches 64 are formed in the distal end of the rod 61, such notches having both radial and axial portions so as to have a somewhat L-shaped cross-section, and corresponding inwardly-projecting prongs 65 are formed on the proximal ends of the legs 62, or the ends opposite the tines 63, so as to engage or fit within the notches 64. By thus positioning the respective tines 63, and thus the legs 62, in the respective notches 64, a sleeve 66 slidable along the rod 61 may then be slid distally and rotated to engage external threads 67 formed on the distal end of the rod 61, thereby effectively trapping the legs 62 within the notches 64 and thus securing the legs 62 onto the rod 61 so as to form the completed extension handle 60. It will be appreciated by those skilled in the art that while a particular exemplary construction of the extension handle 60 has been shown and described, the invention is not so limited. Rather, numerous other constructions of the extension handle 60, including the rod 61 and the legs 62, whether unitary or of two or more components, and employing any permanent or temporary fastening means now known or later developed in the art, are possible without departing from the spirit and scope of the invention, such that the extension handle 60 shown and described is to be understood as being merely illustrative. Accordingly, it will be further appreciated that any suitable materials now known or later developed may also be employed in constructing the extension handle 60 of the present invention, including but not limited to plastic, metal and wood in any combination. In the exemplary embodiment, the legs 62 need only be constructed of sufficient material and thickness so as to flex inwardly enough to allow the tines 63 to pass through the opening within the grip 32 of the mop handle 30 and then engage the holes 34 formed therein. Or, it will be appreciated that where the legs 62 are separate components removably installed on the rod 61 as shown and described in connection with FIGS. 11 and 12, the legs 62 may be even stiffer and need not flex at all, but instead may first be separately installed in the grip 32 and then attached to the rod 61 as by tightening of the sleeve 66. In either case or any other such removable attachment, the extension handle 60 is removed from the mop 20 by simply reversing the steps taken to attach the extension handle 60. Furthermore, the rod 61 portion of the extension handle 62 may be solid, hollow, telescoping or of any other such configuration now known or later developed and suitable to a particular application or use of the mop system of the present invention.

Figure 13:
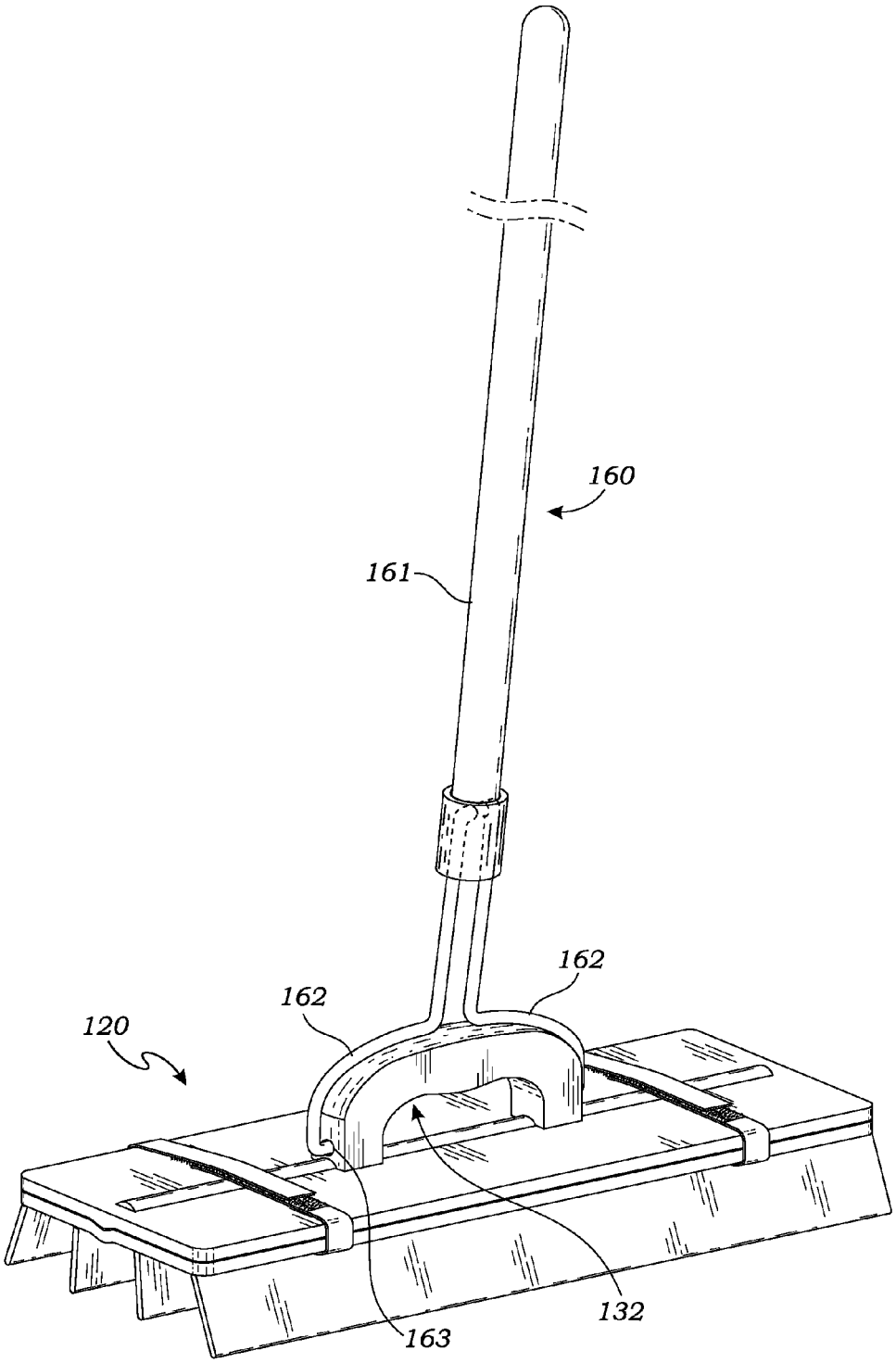
FIG. 13 is a partial perspective view of the mop of FIG. 4 having an alternative extension handle removably installed thereon.

Turning now to FIG. 13, there is shown an alternative embodiment extension handle 160 removably and pivotally attached to the alternative mop 120 shown in FIG. 4. Here, the engagement holes 134 are simply located on an outer surface of the mop handle grip 132 rather than an inner surface, such that the legs 162 of the extension handle 160 now are formed with inwardly—rather than outwardly-projecting tines 163 so as to engage the holes 134. In this configuration, it will be appreciated that the extension handle is capable of pivoting essentially through one-hundred eighty degrees (180°) relative to the mop 120, and that without the need to form any additional bends in the legs 162 other than to clear or span the outer surface or profile of the grip 132. As with the embodiment of the extension handle 60 shown in FIGS. 8-12, the legs 162 may either engage the holes 134 by simply being flexed outwardly, or if the legs 162 are of a relatively stiffer construction and are separate components from the rod 161, the tines 163 may be engaged with the holes 134 first and then the legs 162 may be secured to the rod 161 as above-described. Again, other means for forming the legs and rod integrally or for removably or permanently installing these components to form the extension handle 160 are possible without departing from the spirit and scope of the invention.

Figure 14:
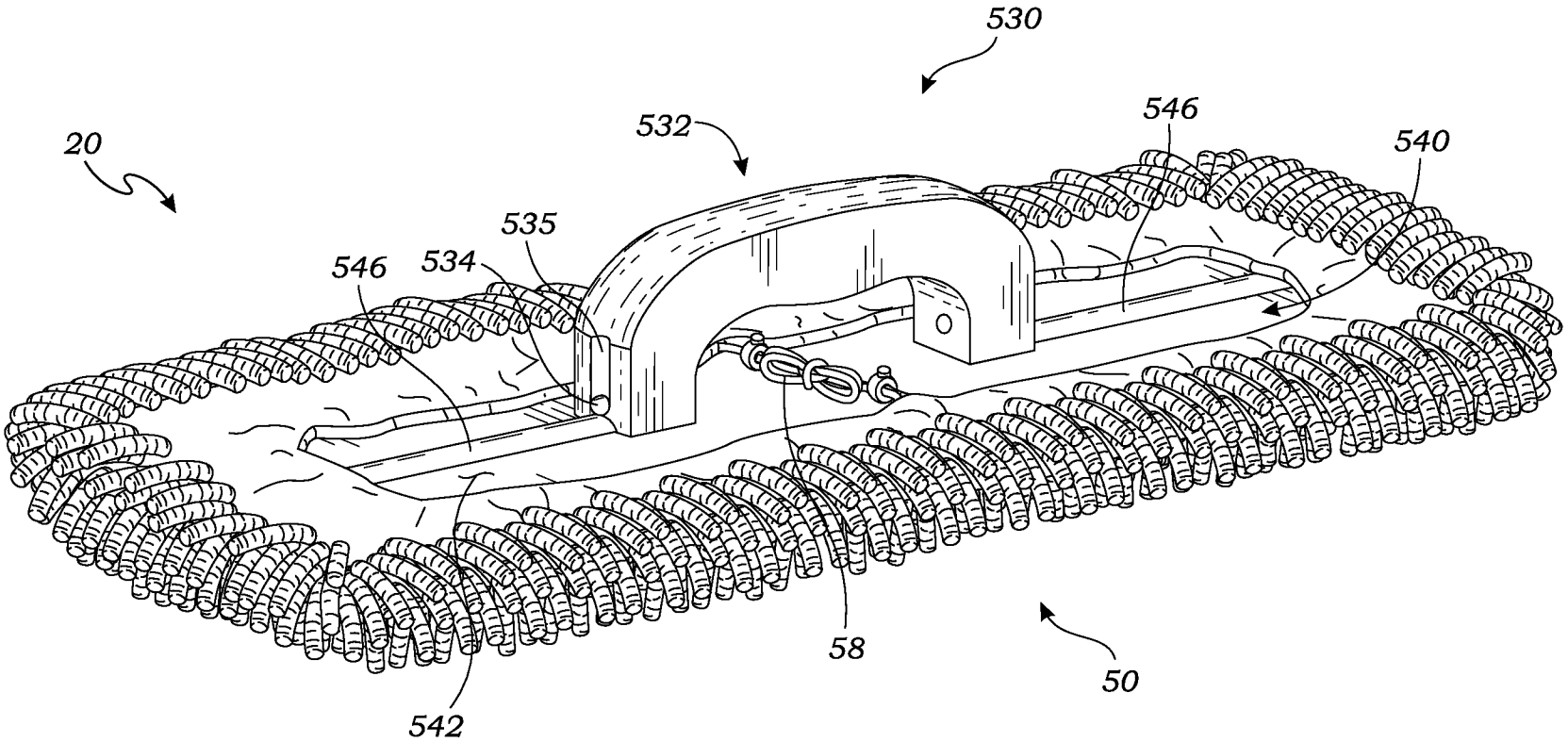
FIG. 14 is a perspective view of a further alternative embodiment of the mop thereof.

Turning briefly to FIG. 14, there is shown a still further alternative mop 20 with a mop handle 530 configured again with outside holes 534 as in the case of the mop system shown in FIGS. 4 and 13. Here, in addition, and to help further guide the inwardly-projecting tines 163 of the opposite legs 162 into the respective holes 534, guiding channels 535 are formed vertically along the outer surfaces of the grip 532 so as to transition from the curved upper surface to the holes 534. Furthermore, the spine or rib 546 formed on the upper surface 542 of the handle base 540 is shown in the alternative embodiment of FIG. 14 as not extending all the way across the length of the base 540, and particularly not spanning the area underneath the grip 532. In this way, it will be appreciated that relatively greater clearance beneath the grip 532 is thus provided, both for a user's hand and to accommodate the attachment means 58, here again configured as drawstrings with locking clamps.

Figure 15:
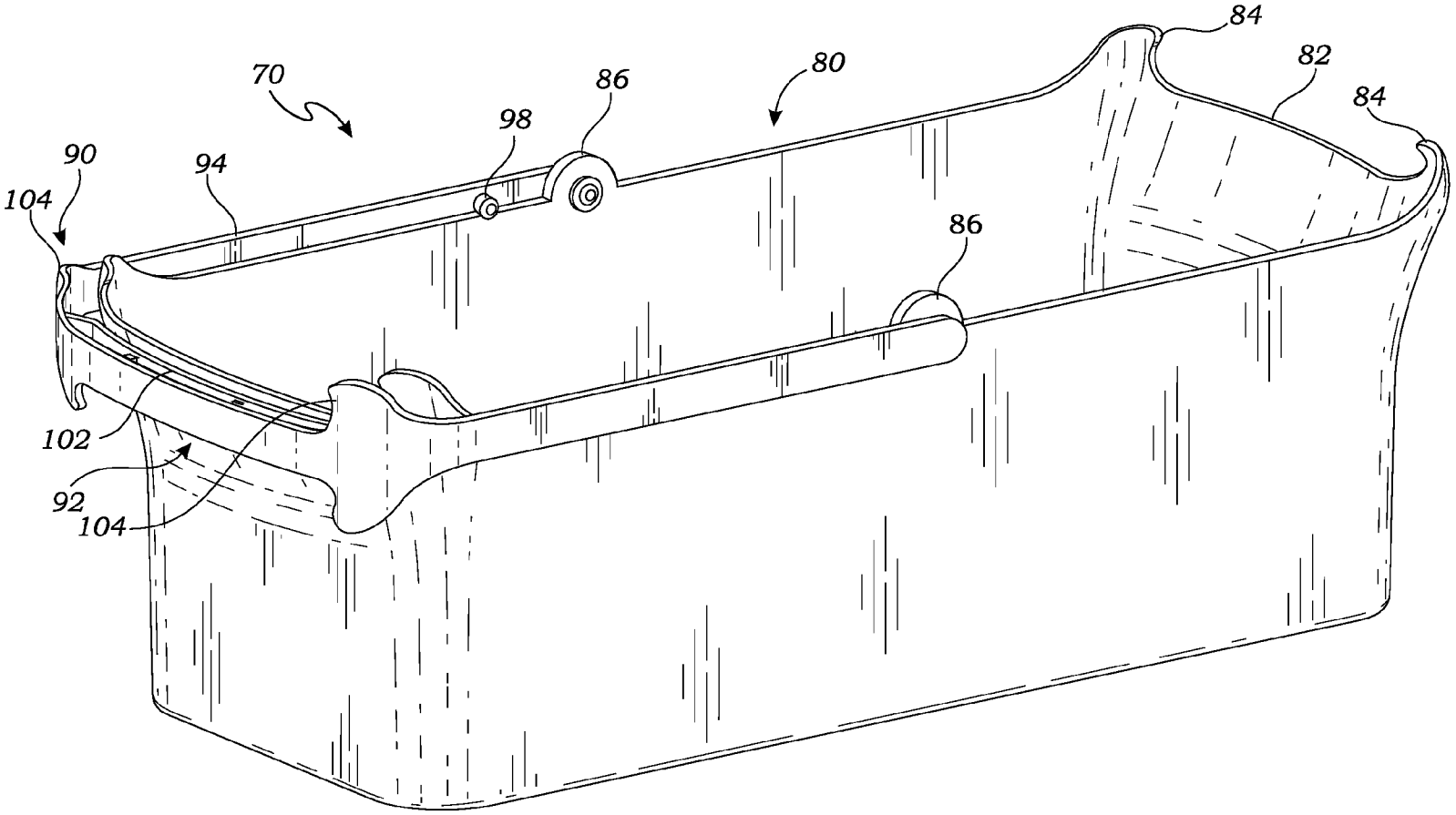
FIG. 15 is a perspective view of a bucket of the mop system of FIG. 1 with the bucket handle in a first position.
Figure 16:
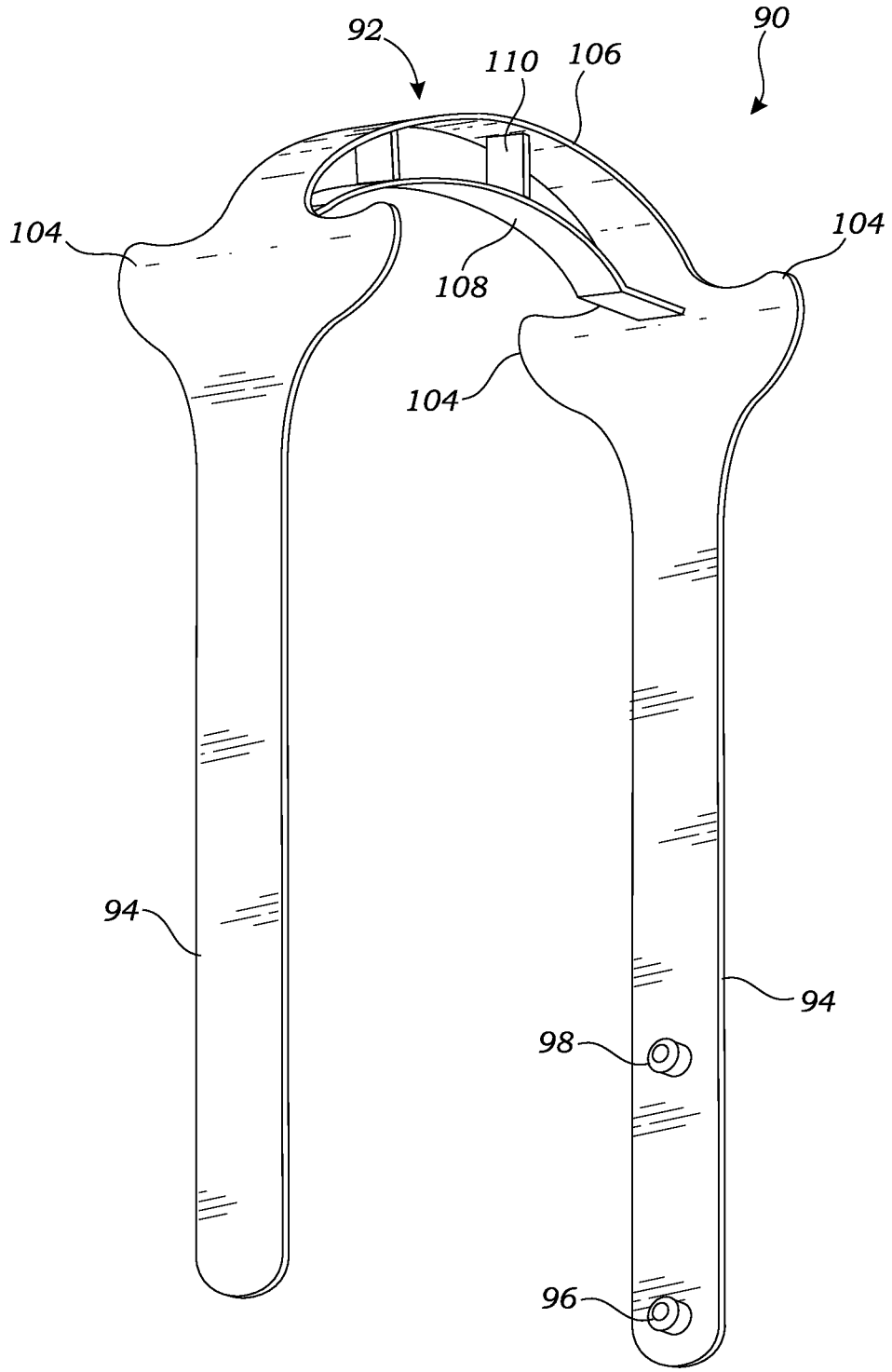
FIG. 16 is an enlarged perspective view of the bucket handle thereof.
Figure 17:
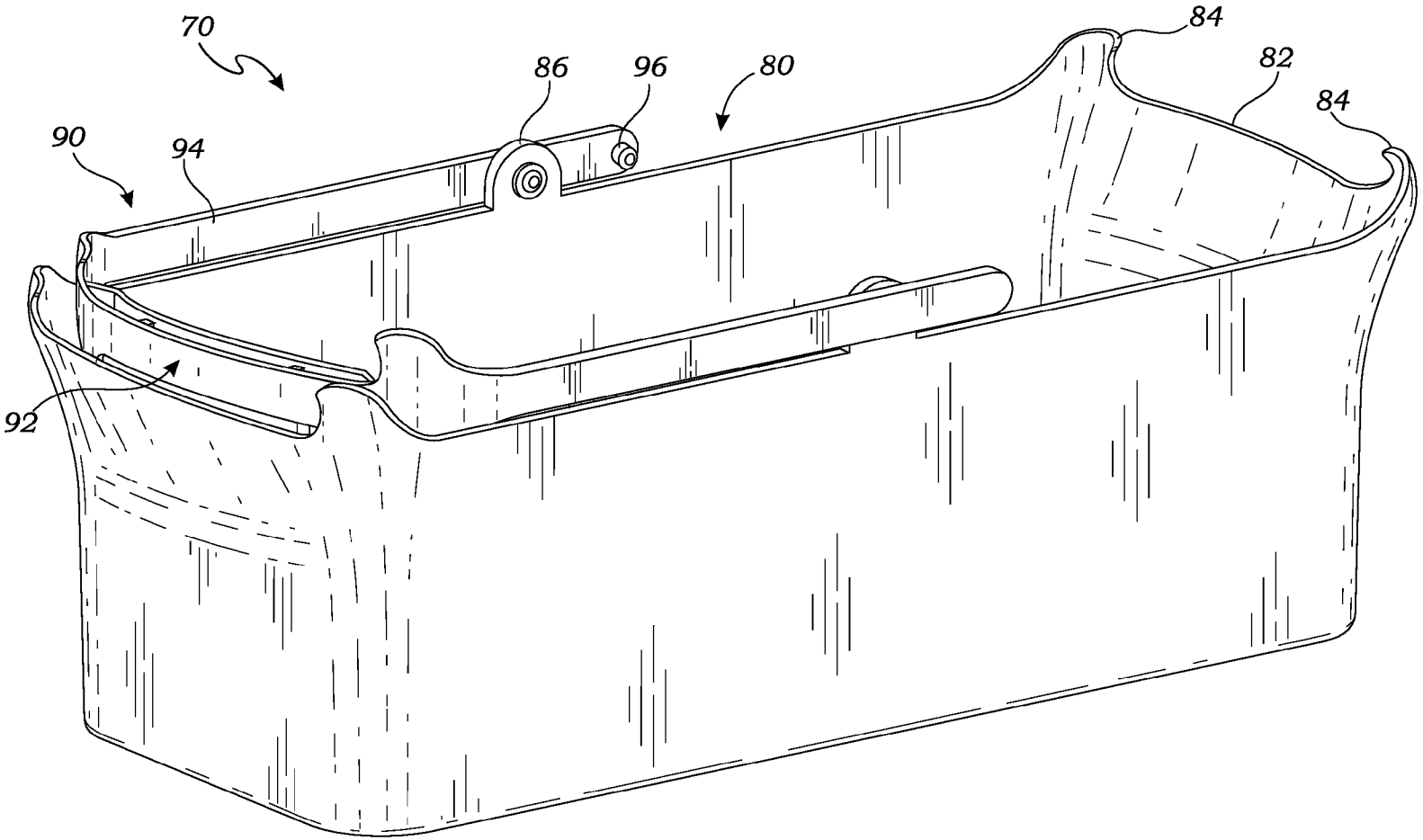
FIG. 17 is a perspective view of the bucket of the mop system of FIG. 1 with the bucket handle in a second position.

Referring to FIGS. 15-17, there are shown perspective views of the bucket 70 component of the multi-purpose mop system 10 of the present invention. The bucket 70 generally comprises a basin 80 and a bucket handle 90 removably and pivotally installed thereon. As best seen in FIG. 13, the bucket handle 90 is formed with a central portion 92 interconnecting opposite leg portions 94. Along and projecting substantially inwardly from the inside surfaces of the leg portions substantially at the distal end thereof, or the end of each leg portion opposite the central portion, are offset first and second pegs 96, 98. The basin 80 is in turn configured with opposite tabs 86 substantially centered along the upper lengthwise edges of the generally rectangular basin 82, each such tab 86 being formed with a through-hole configured to receive a selected one of the pegs 96, 98. In a first position of the bucket handle 90 on the basin 80, as shown in FIG. 15, the most distal pair of pegs 96, or the pegs farthest from the central portion 92 of the bucket handle 90, are removably inserted, as by a press- or snap-fit arrangement, within the through-holes of the tabs 86, thereby locating the central portion 92, as dictated by the length of the leg portions 94 of the bucket handle 90, outside the perimeter of the basin 80. Such a configuration of the bucket 70 would thus be advantageous when, for example, multiple buckets 70 are to be stacked one inside the other.

Whereas, when the bucket 70 is in use with the mop 20 of the multi-purpose mop system 10, as described in more detail below in connection with FIG. 18, the second pair of pegs 98 located proximal of the first pair of pegs 96 are instead engaged in the tabs 86 on the basin 80, thereby locating the central portion 92 inside the perimeter of the basin 80, as best seen in FIG. 17, the significance of which will be appreciated by those skilled in the art based on the below discussion relating to the mop system 10 in use. But first, with continued reference to FIGS. 15-17, it can be seen that along the upper edge of each short side of the basin 80 there is formed a substantially horizontal, upwardly-opening basin channel 82 as defined by opposite, upwardly-projecting basin fingers 84. The basin channels 82 formed on opposite short sides of the basin 80 are preferably substantially the same so as to render the basin 80 substantially symmetrical. Similarly, the central portion 92 of the bucket handle 90 is also formed with a handle channel 102 as defined by opposite handle fingers 104. In the exemplary embodiment, a handle channel 102 with opposite handle fingers 104 is formed on each side of the bucket handle's central portion 92 such that the bucket handle 90 is also substantially symmetrical and so functions substantially the same way whether laid to the left or right along the top edge of the basin 80. Further in the exemplary embodiment, the basin channels 82 and the handle channels 102 are of substantially the same width and depth, as corresponding to the width and depth of the mop 20, or the dimensions of the handle base 40 in combination with the cleaning attachment 50. As best seen in FIG. 16, the central portion 92 of the bucket handle 90 may be formed of two substantially parallel walls 106, 108 interconnected at at least their ends to the leg portions 94 and possibly by at least one intermediate stringer 110. As such, it will be appreciated that the handle channel 102 is functionally defined in the transverse direction by two edges: one edge of each of the two walls 106, 108. A third edge is then defined by the basin channel 82. The significance of this structure will again be further appreciated in the context of the mop system 10 in use. It will be appreciated by those skilled in the art that the corners of the bucket handle 90 may vary from sharp to rounded in various degrees to control the amount of solution being wrung from the mop 20 proportional to the amount of pressure required.

Figure 18:
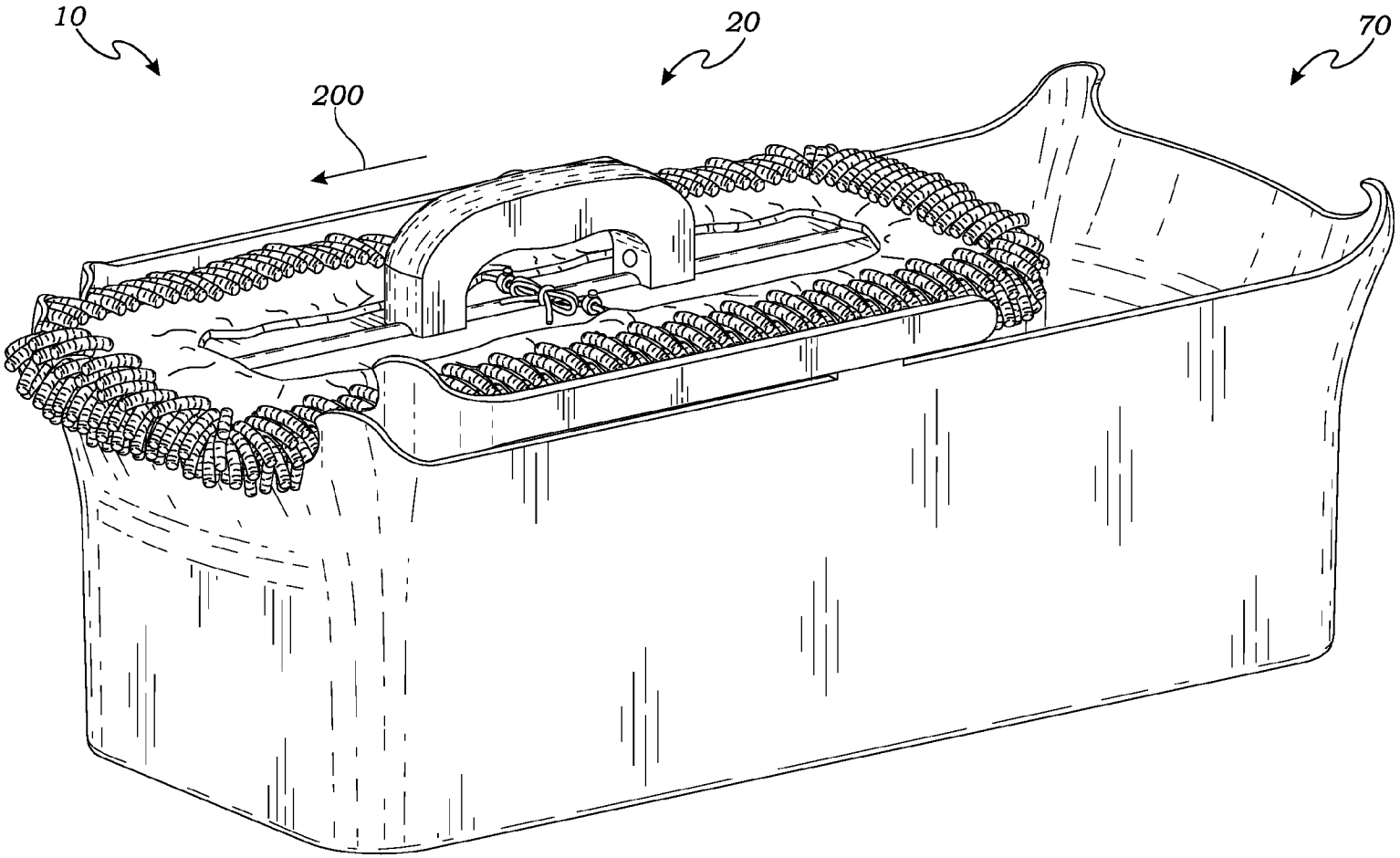
FIG. 18 is a perspective view of the mop system of FIG. 1 in use.

Turning, then, to FIG. 18, in use with the bucket 70 of the multi-purpose mop system 10 configured as shown in FIG. 17 with the bucket handle 90 in its inset position through the engagement of the proximal pegs 98 with the basin's opposite tabs 86, such that the central portion 92 of the bucket handle 90 is located inside the perimeter of the basin 80, it will be appreciated that the respective handle channel 102 and basin channel 82 are substantially offset and aligned so as to yield, in effect, a single channel having three transverse, horizontal, upwardly-facing edges and two vertical, inwardly-facing edges, the latter as formed by the handle fingers 104 and basin fingers 84. This second position or configuration of the bucket 70 is thus rendered operable for wet mopping with the mop 20 of the present invention, whereby the mop 20 may be dipped in the basin 80 so as to rinse the cleaning attachment or mop material 50 and/or soak up relatively fresh water, cleaning solution or whatever desirable fluid has been filled in the basin 80. The mop 20 may then be selectively wrung by simply dragging or pulling the mop 20 in the direction of arrow 200 through the respective handle and basin channels 102, 82 and fingers 104, 84 so as to squeeze excess liquid from the mop material 50, which liquid, it will be appreciated, will substantially run or drip back into the basin 80 due to the inset location of the bucket handle 90, and the central portion 92 and handle channel 102 particularly. In this manner, the waste, mess, and danger of excess water or other cleaning solution spilling out onto the floor or other surface as the mop 20 is being wrung is minimized according to the structure and principles of operation of the multi-purpose mop system 10 of the present invention. Again, the mop 20 may be used to clean virtually any surface, either by grasping the grip 32 of the mop handle 30 and so using the mop 20 as a "hand mop" or by attaching the extension handle 60 and using the mop 20 as a "push mop" to clean a floor or a relatively high or hard to reach surface. Whether used wet or dry, when the cleaning to be done with the mop 20 is completed, the mop may simply be hung up to dry or stored where convenient, or the mop material 50 may be removed from the handle 30 for further cleaning, either by hand as under a faucet or in a sink or even by being placed in an automatic washer and dryer in the conventional method. The mop material 50 and the handles 30, 60 along with the bucket 70 are all both reusable and replaceable relative to one another, rendering the system 10 easily and cost-effectively adapted and maintained. As will be appreciated from the foregoing, the cleaning attachments, such as the mop material 50 or squeegee 150, can thus be easily substituted one for the other on the same mop handle 30 and extension handle 60 to suit a particular use. As such, those skilled in the art will appreciate that the multi-purpose mop system 10 of the present invention has increased versatility and maneuverability over conventional mops and is yet relatively easy and inexpensive to manufacture as being made from readily available materials through conventional fabrication and assembly methods.

To summarize, regarding the exemplary embodiments of the present invention as shown and described herein, it will be appreciated that a multi-purpose mop apparatus is disclosed and configured for convenient and stable wet or dry use on a variety of horizontal and vertical surfaces. Because the principles of the invention may be practiced in a number of configurations beyond those shown and described, it is to be understood that the invention is not in any way limited by the exemplary embodiments, but is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A multi-purpose mop apparatus comprising:

a mop handle having a base and a grip installed thereon for manipulating the mop apparatus during use, the grip being formed with opposite holes formed on respective outside surfaces of the grip so as to be substantially opposite and outwardly-opening, the grip being further formed with opposite guiding channels so as to intersect the respective holes;

a cleaning attachment removably mounted on the base; and an extension handle selectively and removably attached to the mop handle, the extension handle having a lengthwise gripping rod and a pair of legs extending from an end of the rod and formed at the distal ends thereof with tines configured for seating in the holes formed in the grip, the tines being configured to be substantially inwardly-projecting so as to flexibly engage the respective opposite holes and thereby secure the extension handle on the mop handle, the channels serving to cooperate in guiding the inwardly-projecting tines into the holes, the tines being further formed so as to span the grip, whereby the extension handle is pivotable relative to the mop handle through at least approximately a full one-hundred-eighty-degree arc, the legs being further formed with intermediate bends, whereby in a first operable configuration with the bends in the legs substantially toward the grip, the extension handle is pivoted away from the grip in a first mode of operation and the extension handle is pivoted toward the grip such that the legs are brought substantially adjacent to the grip in a second mode of operation, thereby enabling simultaneous grasping of the grip and at least one of the legs of the extension handle for manipulation of the mop apparatus through the grip without removal of the extension handle.

2. The apparatus of claim 1 wherein:

two notches are formed at the end of the rod configured to engage respective inwardly-projecting prongs formed on the proximal ends of the legs so as to removably secure the legs to the rod;

threads are formed at the end of the rod substantially adjacent the notches; and a rotatable sleeve is slid over the rod for threadably engaging the threads and so selectively securing the prongs within the notches and hence securing the legs on the rod.

3. The apparatus of claim 1 wherein the base of the mop handle is formed on a top surface with at least one substantially lengthwise top rib.

4. The apparatus of claim 1 wherein the cleaning attachment comprises a mop material having a fabric substrate with a plurality of micro-fiber cleaning elements affixed thereto, the substrate forming a pocket for selective receipt of the base of the mop handle and having a means for attaching the cleaning attachment to the mop handle during use.

5. The apparatus of claim 1 wherein the cleaning attachment comprises a squeegee having a substrate configured to be located substantially adjacent a bottom surface of the base of the mop handle and at least one cleaning element in the form of a lengthwise blade extending from the substrate substantially opposite the base, the squeegee further having a means for attaching the cleaning attachment to the mop handle during use.

6. A multi-purpose mop apparatus comprising:

a mop handle having a base and an integral grip thereon for manipulating the mop apparatus during use, the grip being formed with holes on respective inside surfaces of the grip so as to be substantially opposite and inwardly-opening;

a cleaning attachment removably mounted on the base; and an extension handle selectively attached to the mop handle, the extension handle having a lengthwise gripping rod and a pair of legs extending from an end of the rod and formed at the distal ends thereof with tines configured to be substantially outwardly-projecting so as to flexibly engage the respective opposite inwardly-opening holes of the grip and thereby secure the extension handle on the mop handle, the legs being further formed with intermediate bends, whereby in a first operable configuration with the bends in the legs substantially toward the grip, the extension handle is pivoted away from the grip in a first mode of operation and the extension handle is pivoted toward the grip such that the legs are brought substantially adjacent to the grip in a second mode of operation, thereby enabling simultaneous grasping of the grip and at least one of the legs of the extension handle for manipulation of the mop apparatus through the grip without removal of the extension handle, further whereby in the first operable configuration the extension handle is pivotable relative to the mop handle through at least approximately a sixty-degree arc, and further whereby in a second operable configuration with the bends in the legs substantially away from the grip the extension handle may be pivoted past ninety degrees and so oriented at least partially below the base of the mop handle for cleaning of substantially horizontal overhead surfaces.

7. The apparatus of claim 6 wherein a foam pad is installed between the base of the mop handle and the removable cleaning attachment.

8. The apparatus of claim 6 wherein:

two notches are formed at the end of the rod configured to engage respective inwardly-projecting prongs formed on the proximal ends of the legs so as to removably secure the legs to the rod;

threads are formed at the end of the rod substantially adjacent the notches; and a rotatable sleeve is slid over the rod for threadably engaging the threads and so selectively securing the prongs within the notches and hence securing the legs on the rod.

9. The apparatus of claim 6 wherein the base of the mop handle is formed on a top surface with at least one substantially lengthwise top rib.

10. The apparatus of claim 6 wherein the cleaning attachment comprises a mop material having a fabric substrate with a plurality of micro-fiber cleaning elements affixed thereto, the substrate forming a pocket for selective receipt of the base of the mop handle and having a means for attaching the cleaning attachment to the mop handle during use.

11. The apparatus of claim 10 wherein the attaching means comprises a drawstring fitted about the opening of the pocket, whereby cinching of the drawstring secures the cleaning attachment on the mop handle.

12. The apparatus of claim 11 wherein:

the base of the mop handle is substantially rectangular and the grip is installed thereon substantially along the lengthwise axis thereof; and the drawstring is configured with opposite ends substantially located midway along the length of the handle so as to be cinched and tied substantially adjacent the grip, whereby the central portion of the cleaning attachment is further secured on the mop handle.

13. The apparatus of claim 6 wherein the cleaning attachment comprises a squeegee having a substrate configured to be located substantially adjacent a bottom surface of the base of the mop handle and at least one cleaning element in the form of a lengthwise blade extending from the substrate substantially opposite the base, the squeegee further having a means for attaching the cleaning attachment to the mop handle during use.

14. The apparatus of claim 13 wherein the attaching means comprises straps for removably strapping the cleaning attachment to the mop handle as by passing over the top surface of the base and there being removably joined.

15. The apparatus of claim 13 wherein:

a lengthwise bottom rib is formed along the bottom surface of the base of the mop handle; and the substrate is configured to engage the bottom rib so as to further secure the cleaning attachment relative to the mop handle.

16. A method of cleaning a surface, comprising the steps of:

removably securing a cleaning attachment to a mop handle so as to form a mop apparatus, the mop apparatus comprising a mop handle having a base and an integral grip thereon for manipulating the mop apparatus during use, the grip being formed with holes on respective inside surfaces of the grip so as to be substantially opposite and inwardly-opening, the cleaning attachment being removably mounted on the base;

removably and pivotally attaching an extension handle to the mop handle, the extension handle having a lengthwise gripping rod and a pair of legs extending from an end of the rod and formed at the distal ends thereof with tines configured to be substantially outwardly-projecting so as to flexibly engage the respective opposite inwardly-opening holes of the grip and thereby secure the extension handle on the mop handle, the legs being further formed with intermediate bends such that in a first operable configuration the bends formed in the legs of the extension handle are substantially toward the grip of the mop handle;

pivoting the extension handle relative to the mop handle away from the grip so as to render the mop apparatus in a first mode of operation;

positioning the cleaning attachment against the surface to be cleaned and shifting the mop apparatus over the surface while maintaining the mop apparatus substantially in the first mode of operation so as to clean the surface;

pivoting the extension handle relative to the mop handle toward the grip so as to render the mop apparatus in a second mode of operation wherein the legs are substantially adjacent the grip; and grasping the grip and at least one of the legs so as to manipulate the mop for further cleaning or wringing without removal of the extension handle, whereby in the first operable configuration the extension handle is pivotable relative to the mop handle through at least approximately a sixty-degree arc, and further whereby in a second operable configuration with the bends in the legs substantially away from the grip the extension handle may be pivoted past ninety degrees and so oriented at least partially below the base of the mop handle for cleaning of substantially horizontal overhead surfaces.

17. The method of claim 16 comprising the further steps of:

removably and pivotally attaching the extension handle to the mop handle in the second operable configuration such that the bends formed in the legs of the extension handle are substantially away from the grip of the mop handle; and pivoting the extension handle relative to the mop handle away from the grip so as to render the mop apparatus in a third mode of operation wherein the extension handle is shifted past ninety degrees and so oriented at least partially below a base of the mop handle for overhead cleaning of substantially horizontal surfaces.

18. The method of claim 16 wherein the step of removably securing the cleaning attachment further comprises:

inserting a base of the mop handle within a pocket formed in a substrate of the cleaning material;

cinching a drawstring having two free ends and fitted about the opening of the pocket to secure the cleaning attachment on the mop handle; and tying the free ends of the drawstring once cinched.

19. The method of claim 16 wherein the step of removably and pivotally attaching the extension handle to the mop handle further comprises flexing the legs formed at an end of a rod of the extension handle so as to allow laterally-projecting tines formed on the distal ends of the legs to engage holes formed in the grip of the mop handle.

20. The method of claim 16 wherein the step of removably and pivotally attaching the extension handle to the mop handle further comprises:

inserting laterally-projecting tines formed on the distal ends of the legs within holes formed in the grip of the mop handle;

inserting inwardly-projecting prongs formed on the proximal ends of the legs within respective notches formed at the end of a rod of the extension handle; and slidably threading a sleeve of the rod over the prongs so as to secure the legs on the rod and thereby removably secure the extension handle to the mop handle.

* * * * *